US005928857A

United States Patent [19]

Geisler et al.

[11] Patent Number: 5,928,857

[45] **Date of Patent: *Jul. 27, 1999**

[54] PHOTOTHERMOGRAPHIC ELEMENT WITH IMPROVED ADHERENCE BETWEEN LAYERS

[75] Inventors: Thomas C. Geisler, Cottage Grove; Kimberly K. Marquardt, Minneapolis, both of Minn.

[73] Assignee: Minnesota Mining and Manufacturing Company, St. Paul, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/769,093

[22] Filed: Dec. 18, 1996

Related U.S. Application Data

[63] Continuation of application No. 08/559,790, Nov. 15, 1995, abandoned, which is a continuation-in-part of application No. 08/340,620, Nov. 16, 1994, abandoned.

[51] Int. Cl.[6] ..... G03C 1/498

[52] U.S. Cl. ..... 430/619; 430/530; 430/531; 430/617

[58] Field of Search ..... 430/617, 619, 430/545, 954, 203, 530, 531, 534, 535

[56] References Cited

U.S. PATENT DOCUMENTS

| | | |
|---|---|---|
| 1,623,499 | 4/1927 | Sheppard et al. . |
| 2,131,038 | 9/1938 | Brooker et al. . |
| 2,274,782 | 3/1942 | Gáspár . |

(List continued on next page.)

FOREIGN PATENT DOCUMENTS

| | | | |
|---|---|---|---|
| 0 251 282 A2 | 6/1987 | European Pat. Off. . | |
| 439944 | 8/1991 | European Pat. Off. | G03C 1/498 |
| 0 473 292 A2 | 3/1992 | European Pat. Off. . | |
| 0 523 465 A1 | 7/1992 | European Pat. Off. . | |
| 0 559 228 A1 | 3/1993 | European Pat. Off. . | |
| 533008 | 3/1993 | European Pat. Off. . | |
| 616014 | 2/1994 | European Pat. Off. . | |
| 627660 | 12/1994 | European Pat. Off. . | |
| 52-126780 | 10/1977 | Japan . | |
| 54-65026 | 5/1979 | Japan . | |
| 61-042486 | 2/1986 | Japan . | |
| 63-95434 | 4/1988 | Japan . | |
| 623448 | 5/1949 | United Kingdom . | |
| 837095 | 6/1960 | United Kingdom . | |
| 955061 | 4/1964 | United Kingdom . | |
| 1326889 | 8/1973 | United Kingdom . | |

OTHER PUBLICATIONS

Abstract of JP 54 65026 dated May 24, 1979, Derwent World Patent Abstracts (1996) no month.

Abstract of JP 56 05536 dated Jan. 21, 1981, Derwent World Patent Abstracts (1996) no month.

Abstract of JP 63 95434 dated Apr. 26, 1988, Derwent World Patent Abstracts (1996) no month.

*Unconventional Imaging Processes,* E. Brinckman et al., Ed.; The Focal Press, London and New York, 74–75 (1978).

T. H. James, Chapter 5 in *The Theory of the Photographic Process, Fourth Ed.,* Eastman Kodak Company, Rochester, New York, 149–169 (1977).

"Photothermographic Silver Halide Material and Process," Item 22812 in *Research Disclosure,* pp. 155–156 (Apr. 1983).

"Carbamoyloxy Substituted Couplers in a Photothermographic Element and Process," Item 23419 in *Research Disclosure,* pp. 314–315 (Oct. 1983).

D. H. Klosterboer, "Thermally Processed Silver Systems, "Chapter 9 of *Imaging Processes and Materials, Neblette's Eighth Edition,* J. Sturge et al., Ed., Van Nostrand Reinhold, New York, 279–291 (1989).

K. Venkataraman, *The Chemistry of Synthetic Dyes,* Academic Press: New York, 1952 vol. 4, Chapter VI.

"Photothermographic Silver Halide Systems," Item No. 17029 in *Research Disclosure,* pp. 9–15 (Jun. 1978).

K. Venkataraman, "The Photographic Color Development Process," Chapter VI of *The Chemistry of Synthetic Dyes,* Academic Press: New York, vol. 4, 1971.

U.S. Patent Application 50423USA8A filed May 11, 1994, Serial No. 08/198,970, "Iimproved Imaging Process for Imaging Materals."

U.S. Patent Application 48971USA1A filed Jun. 4, 1993, Serial No. 08/072,153, "Infrared Sensitized, Photothermographic Article."

U.S. Patent Application 48971USA9B filed Aug. 29, 1994, Serial No. 08/297,598, "Infrared, Sensitized Photothermographic Article."

U.S. Patent Application 48971USA7C filed Sep. 28, 1994, Serial No. 0/314,211, "Infrared, Sensitized Photothermographic Article."

"Electrophotographic Laser Copier Printer Scanner," SPIE, vol. 390, (1983), by W. I. Imaino, R. T. Kerth, J. C. King, and B. J. Milander, IBM Research Laboratory.

*Primary Examiner*—Thorl Chea
*Attorney, Agent, or Firm*—William K. Weimer

[57] ABSTRACT

A spectrally sensitized photothermographic silver halide element comprising a support layer having on at least one surface thereof a photothermographic composition, said composition comprising a polyvinyl acetal binder, a light insensitive silver source, a reducing agent for silver ion and infrared radiation sensitive silver halide grains, wherein said composition also comprises a polymeric component which is not a polyvinyl acetal, or a metal soap other than a silver soap of an organic acid (especially not the long chain fatty acid normally present in silver halide based photothermographic elements) which is dispersed in said composition in an amount of from 0.3 to 20% by weight of said polyvinyl acetal, which polymeric component has higher strength of adhesion to polyester film than does the polyvinyl acetal, and said polymeric may exist as a separate phase within said polyvinyl acetal.

20 Claims, No Drawings

U.S. PATENT DOCUMENTS 2,399,083 4/1946 Waller et al. .
2,444,605 7/1948 Heimbach et al. .
2,489,341 11/1949 Waller et al. .
2,527,583 10/1950 Silberstein et al. .
2,565,418 8/1951 Yackel .
2,566,263 8/1951 Trivelli et al. .
2,588,765 3/1952 Robijns et al. .
2,597,915 5/1952 Yutzy et al. .
2,614,928 10/1952 Yutzy et al. .
2,618,556 11/1952 Hewitson et al. .
2,681,294 6/1954 Beguin .
2,694,716 11/1954 Allen et al. .
2,701,245 2/1955 Lynn .
2,728,663 12/1955 Allen et al. .
2,761,791 9/1956 Russell .
2,839,405 6/1958 Jones .
2,861,056 11/1958 Minsk .
2,886,437 5/1959 Piper .
2,956,879 10/1960 Van Campen .
2,960,404 11/1960 Milton et al. .
2,992,101 7/1961 Jelley et al. .
3,080,254 3/1963 Grant, Jr. .
3,121,060 2/1964 Duane .
3,201,678 8/1965 Meixell .
3,206,312 9/1965 Sterman et al. .
3,220,839 11/1965 Herz et al. .
3,235,652 2/1966 Lindsey .
3,241,969 3/1966 Hart .
3,253,921 5/1966 Sawdey .
3,282,699 11/1966 Jones et al. .
3,287,135 11/1966 Anderson et al. .
3,297,446 1/1967 Dunn .
3,297,447 1/1967 McVeigh .
3,330,663 7/1967 Weyde et al. .
3,428,451 2/1969 Trevoy .
3,432,300 3/1969 Lestina et al. .
3,457,075 7/1969 Morgan et al. .
3,573,050 3/1971 Brannock et al. .
3,574,627 4/1971 Stern et al. .
3,698,909 10/1972 Lestina et al. .
3,700,458 10/1972 Lindholm .
3,764,337 10/1973 Arai et al. .
3,785,830 1/1974 Sullivan et al. .
3,816,122 6/1974 Hamb .
3,839,049 10/1974 Simons .
3,847,612 11/1974 Winslow .
3,856,526 12/1974 Hamb et al. .
3,885,965 5/1975 Hughes et al. ..... 96/48 HD
3,909,271 9/1975 Ikenoue et al. .
3,985,565 10/1976 Gabrielsen et al. .
4,042,394 8/1977 Smith, Jr. et al. .
4,076,539 2/1978 Ikenoue et al. .
4,123,274 10/1978 Knight et al. .
4,123,282 10/1978 Winslow .
4,161,408 7/1979 Winslow et al. .
4,220,709 9/1980 deMauriac .
4,260,677 4/1981 Winslow et al. .
4,273,844 6/1981 Kobayashi et al. ..... 430/48
4,291,120 9/1981 Kobayashi et al. ..... 430/531
4,374,921 2/1983 Frenchik .
4,425,425 1/1984 Abbott et al. .
4,425,426 1/1984 Abbott et al. .
4,435,499 3/1984 Reeves ..... 430/350
4,460,681 7/1984 Frenchik .
4,563,415 1/1986 Brown et al. .
4,587,211 5/1986 Ishida et al. .
4,594,307 6/1986 Ishida .
4,622,395 11/1986 Bellus et al. .
4,708,928 11/1987 Geisler .
4,710,570 12/1987 Thien .
4,711,838 12/1987 Grzeskowiak et al. .
4,725,534 2/1988 Kagami et al. ..... 430/619
4,761,361 8/1988 Ozaki et al. .
4,775,613 10/1988 Hirai et al. .
4,782,010 11/1988 Mader et al. .
4,795,697 1/1989 Vogel et al. .
4,806,461 2/1989 Ikeda et al. .
4,835,096 5/1989 Lea .
4,839,265 6/1989 Ohno et al. .
4,871,656 10/1989 Parton et al. .
4,882,265 11/1989 Laganis et al. .
4,904,557 2/1990 Kubo .
4,923,792 5/1990 Grieve et al. .
4,981,775 1/1991 Swain et al. .
5,104,777 4/1992 Schmidt et al. .
5,135,842 8/1992 Kitchin et al. .
5,196,300 3/1993 Urabe et al. .
5,258,282 11/1993 Kagami et al. .
5,264,321 11/1993 Kenney et al. .
5,266,452 11/1993 Kitchin et al. .
5,294,526 3/1994 Przedziecki et al. ..... 430/619
5,314,795 5/1994 Helland et al. .
5,380,644 1/1995 Yonkoski et al. .
5,382,504 1/1995 Shor et al. .
5,434,043 7/1995 Zou et al. .
5,441,866 8/1995 Miller et al. .

PHOTOTHERMOGRAPHIC ELEMENT WITH IMPROVED ADHERENCE BETWEEN LAYERS

This is a continuation of application Ser. No. 08/559,790 filed Nov. 15, 1995, now abandoned, which is a continuation-in-part of U.S. application Ser. No. 08/340,620 filed Nov. 16, 1994, now abandoned.

BACKGROUND OF THE INVENTION

1. Field of the Invention

This invention relates to radiation sensitized, photothermographic elements composed of silver halide, a reducible silver source, a reducing agent for silver ion, and a binder and in particular to such photothermographic elements having emulsion coatings which display improved adhesion to adjacent layers and particularly improved adhesion to polymeric film base and supports.

2. Background of the Art

Silver halide-containing, photothermographic imaging materials (i.e., heat-developable photographic elements) processed with heat, and without liquid development, have been known in the art for many years. These materials are also known as "dry silver" compositions or emulsions and generally comprise a support having coated thereon: (a) a photosensitive material that generates silver atoms when irradiated; (b) a non-photosensitive, reducible silver source; (c) a reducing agent (i.e., a developer) for silver ion, for example that silver ion in the non-photosensitive, reducible silver source; and (d) a binder.

The photosensitive material is generally photographic silver halide which must be in catalytic proximity to the non-photosensitive, reducible silver source. Catalytic proximity requires an intimate physical association of these two materials so that when silver atoms (also known as silver specks, clusters, or nuclei) are generated by irradiation or light exposure of the photographic silver halide, those nuclei are able to catalyze the reduction of the reducible silver source. It has long been understood that silver atoms (Ag°) are a catalyst for the reduction of silver ions, and that the photosensitive silver halide can be placed into catalytic proximity with the non-photosensitive, reducible silver source in a number of different fashions. For example, catalytic proximity can be accomplished by partial metathesis of the reducible silver source with a halogen-containing source (see, for example, U.S. Pat. No. 3,457,075); by coprecipitation of silver halide and the reducible silver source material (see, for example, U.S. Pat. No. 3,839,049); and other methods that intimately associate the photosensitive, photographic silver halide and the non-photosensitive, reducible silver source.

The non-photosensitive, reducible silver source is a material that contains silver ions. Typically, the preferred non-photosensitive reducible silver source is a silver salt of a long chain aliphatic carboxylic acid having from 10 to 30 carbon atoms. The silver salt of behenic acid or mixtures of acids of similar molecular weight are generally used. Salts of other organic acids or other organic materials, such as silver imidazolates, have been proposed. U.S. Pat. No. 4,260,677 discloses the use of complexes of inorganic or organic silver salts as non-photosensitive, reducible silver sources.

In both photographic and photothermographic emulsions, exposure of the photographic silver halide to light produces small clusters of silver atoms (Ag°). The imagewise distribution of these clusters is known in the art as a latent image.

This latent image is generally not visible by ordinary means. Thus, the photosensitive emulsion must be further processed to produce a visible image. This is accomplished by the reduction of silver ions which are in catalytic proximity to silver halide grains bearing the clusters of silver atoms, i.e., the latent image.

In a photothermographic element, the reducing agent for the organic silver salt, often referred to as a "developer," may be any material, preferably any organic material, that can reduce silver ion to metallic silver. At elevated temperatures, in the presence of the latent image, the non-photosensitive reducible silver source (e.g., silver behenate) is reduced by the reducing agent for silver ion. This produces a negative black-and-white image of elemental silver.

While conventional photographic developers such as methyl gallate, hydroquinone, substituted hydroquinones, hindered phenols, catechol, pyrogallol, ascorbic acid, and ascorbic acid derivatives are useful, they tend to result in very reactive photothermographic formulations and fog during preparation and coating of photothermographic elements. As a result, hindered bisphenol reducing agents have traditionally been preferred.

As the visible image in black-and-white photothermographic elements is usually produced entirely by elemental silver (Ag°), one cannot readily decrease the amount of silver in the emulsion without reducing the maximum image density. However, reduction of the amount of silver is often desirable to reduce the cost of raw materials used in the emulsion and/or to enhance performance. For example, toning agents may be incorporated to improve the color of the silver image of the photothermographic element. Another method of increasing the maximum image density in photographic and photothermographic emulsions without increasing the amount of silver in the emulsion layer is by incorporating dye-forming or dye-releasing materials in the emulsion. Upon imaging, the dye-forming or dye-releasing material is oxidized, and a dye and a reduced silver image are simultaneously formed in the exposed region. In this way, a dye-enhanced black-and-white silver image can be produced.

The imaging arts have long recognized that the fields of photothermography and thermography are clearly distinct from that of photography. Photothermographic and thermographic elements significantly differ from conventional silver halide photographic elements which require wet-processing.

In photothermographic and thermographic imaging elements, a visible image is created by heat as a result of the reaction of a developer incorporated within the element. Heat is essential for development and temperatures of over 100° C. are routinely required. In contrast, conventional wet-processed photographic imaging elements require processing in aqueous processing baths to provide a visible image (e.g., developing and fixing baths) and development is usually performed at a more moderate temperature (e.g., 30°–50° C.).

In photothermographic elements only a small amount of silver halide is used to capture light and a different form of silver (e.g., silver behenate) is used to generate the image with heat. Thus, the silver halide serves as a catalyst for the development of the non-photosensitive, reducible silver source. In contrast, conventional wet-processed black-and-white photographic elements use only one form of silver (e.g., silver halide) which, upon development, is itself converted to the silver image. Additionally, photothermographic elements require an amount of silver halide per unit area that is as little as one-hundredth of that used in a conventional wet-processed silver halide.

Photothermographic systems employ a light-insensitive silver salt, such as silver behenate, which participates with the developer in developing the latent image. In contrast, photographic systems do not employ a light-insensitive silver salt directly in the image-forming process. As a result, the image in photothermographic elements is produced primarily by reduction of the light-insensitive silver source (silver behenate) while the image in photographic black-and-white elements is produced primarily by the silver halide.

In photothermographic and thermographic elements, all of the "chemistry" of the system is incorporated within the element itself. For example, photothermographic and thermographic elements incorporate a developer (i.e., a reducing agent for the non-photosensitive reducible source of silver) within the element while conventional photographic elements do not. The incorporation of the developer into photothermographic elements can lead to increased formation of "fog" upon coating of photothermographic emulsions as compared to photographic emulsions. Even in so-called instant photography, developer chemistry is physically separated from the silver halide until development is desired. Much effort has gone into the preparation and manufacture of photothermographic and thermographic elements to minimize formation of fog upon coating, storage, and post-processing aging.

Similarly, in photothermographic elements, the unexposed silver halide inherently remains after development and the element must be stabilized against further development. In contrast, the silver halide is removed from photographic elements after development to prevent further imaging (i.e., the fixing step).

In photothermographic and thermographic elements the binder is capable of wide variation and a number of binders are useful in preparing these elements. In contrast, photographic elements are limited almost exclusively to hydrophilic colloidal binders such as gelatin.

Because photothermographic and thermographic elements require thermal processing, they pose different considerations and present distinctly different problems in manufacture and use. In addition, the effects of additives (e.g., stabilizers, antifoggants, speed enhancers, sensitizers, supersensitizers, etc.) which are intended to have a direct effect upon the imaging process can vary depending upon whether they have been incorporated in a photothermographic or thermographic element, or incorporated in a photographic element.

Distinctions between photothermographic and photographic elements are described in *Imaging Processes and Materials* (*Neblette's Eighth Edition*); J. Sturge et al. Ed; Van Nostrand Reinhold: New York, 1989; Chapter 9 and in *Unconventional Imaging Processes*; E. Brinckman et al, Ed; The Focal Press: London and New York: 1978; pp. 74–75.

It is important that the layers of photothermographic elements adhere well to each other. This is normally accomplished by the selection of ingredients in adjacent layers which have good adhesion, the treatment of the support layer to better adhere (e.g., flash lamp, corona discharge, flame treatment, etc.), or by using a primer layer. The fact that polyester (polyethyleneterephthalate or polyethylenenaphthalate) film support is the preferred film support and polyvinyl butyral is the preferred binder for the photothermographic emulsion layer prevents the alteration of those components to improve adhesion.

SUMMARY OF THE INVENTION

The present invention describes constructions which improves the adhesion between layers within a photothermographic imaging system, including those spectrally sensitized to the red or infrared, providing improved adhesion between the emulsion layer and adjacent polymeric binder layers or polymeric support layers.

According to the present invention there is provided a spectrally sensitized photothermographic silver halide element comprising a support layer having on at least one surface thereof a photothermographic composition, said composition comprising a polyvinyl acetal binder, a light insensitive silver source, a reducing agent for silver ion and infrared radiation sensitive silver halide grains, wherein said composition also comprises 1) a dissolved (solution) or dispersed polymeric component which is not a polyvinyl acetal, or 2) a metal soap other than a silver soap of an organic acid (especially not the long chain fatty acid normally present in silver halide based photothermographic elements), which dispersions and/or solutions are in said composition in an amount of from 0.5 to 20% by weight of said polyvinyl acetal, which polymeric component has higher strength of adhesion to polyester film than does the polyvinyl acetal.

As used herein, the term "emulsion layer" means a layer of a photothermographic element that contains photosensitive silver salt (e.g., silver halide) and silver source material.

As used herein the term "photothermographic element" means a construction comprising at least one photothermographic emulsion layer and any supports, topcoat layers, image receiving layers, blocking layers, antihalation layers, subbing or priming layers, etc.

For the purposes of this invention the infrared region of the spectrum is defined as 750–1400 nm, the visible region of the spectrum is defined as 400–750 nm, and the red region of the spectrum is defined as 640–750 nm. Preferably the red region of the spectrum is 650–700 nm.

DETAILED DESCRIPTION OF THE INVENTION

Copending U.S. patent applications Ser. No. 08/297,598 (filed Nov. 23, 1993, now abandoned in favor EP Publication No. 627,660 ) and U.S. Pat. No. 5,434,043 describe most of the characteristics and attributes of a photothermographic element having, for example, an antihalation system, silver halide grains having an average particle size of less than 0.10 $\mu$m, and infrared supersensitization leading to an infrared photothermographic article reaching the requirements for medical or graphic arts laser recording applications.

The adhesion of the emulsion layer containing polyvinyl butyral as the only binder to the support is less than desired for product commercialization. This is especially noticeable in high density image areas where a significant amount of adhesion-promoting silver soap has been consumed and converted to metallic silver and fatty acid, and the coating is easily peeled from the polyester support.

Current photothermographic elements contain polyvinyl butyral as the primary component providing cohesion of the silver containing emulsion layer (first trip). Also polyvinyl butyral has been presumed to be the component responsible for the adhesion of the coating to the polyester support. We recently found that 100% polyvinyl butyral coatings have little adhesion to polyester, indicating that polyvinyl butyral is not the sole ingredient responsible for the adhesion of the silver containing emulsion layer to the polyester support.

Subsequently we found that a coated film consisting of a mixture of polyvinyl butyral and silver soap adheres strongly to polyester. Thus it appears that adhesion of the emulsion layer to the support is provided by the mixture of polyvinyl butyral and silver soap in the silver-containing emulsion layer. This hypothesis is substantiated by the observation that the adhesion of the silver-containing emulsion layer to the support is significantly less in the high density image areas than in low density image areas or in unprocessed film.

The addition of an adhesion promoting resin and/or a metal soap to the silver layer significantly improves the adhesion of the silver layer to the support and is readily observed in high density image areas where adhesion is poor.

Addition of adhesion promoting resins to the photosensitive layer (the silver halide containing layer) can clearly improve the adhesion of the emulsion layer to the support layer (with or without a primer layer thereon).

When adhesion promoting resin particles are generated in the silver halide layer by blending two different resins which are not stable in a single phase (using polyvinyl butyral, for example, as the primary binder for the photothermographic layer(s) containing the silver halide), such binders as polyester resins (e.g., PE 2200 polyester), polyvinyl acetate, resins, etc. separate out of the blend as particles dispersed within the polyvinyl butyral phase. These in situ generated particles have been noted as tending to deposit, contact, or adhere to the support (or primer layer on the support) when the silver halide layer containing these materials is coated on the support. These particles tend to not affect the refractive pattern of the surface of the topcoat layer as they tend to be significantly smaller in size than the thickness of the silver halide containing layer and remain immersed or buried within that layer. These particles may have an average size which appears to be on the order of 1/10 to 2/3 the dimensions of the thickness of the silver halide containing layer.

The addition of a metal soap to the silver layer can also clearly improve the adhesion of the photothermographic emulsion layer to the support layer. By metal soap is meant the metal salt of a long chain aliphatic carboxylic acid having from 10 to 30 carbon atoms.

It is believed that the mechanism which explains this improved adhesion performance is that metal soaps provide good adhesion to substrates and other layers. However, in photothermographic imaging processes the silver soaps are reduced during development, their adhesion properties are removed, and therefore adhesion is worsened. This is a particularly severe problem in those areas where image density is highest due to a greater amount of development and consequent decrease in the amount of remaining silver soap. Metal soaps such as gold, silver, and palladium soaps, which have been added to vary the image tone and the like are not beneficial within the practice of the present invention because they too are reduced and do not remain to improve adhesion in any significant degree beyond what occurs with silver soaps. Thus, addition of any metal soap to the photothermographic emulsion layer which does not oxidize as part of the imaging photothermographic process will remain in the developed areas and will work in the practice of the present invention and serve to promote adhesion. Metal soaps derived from alkali metals (Group I of the periodic table) and alkaline earth metals (Group II of the periodic table) are most conveniently used in the practice of the present invention. These include metals such as lithium, sodium, potassium, rubidium, cesium, beryllium, magnesium, calcium, strontium, barium, etc. Zinc is also very effective. These soaps are not substantially reduced to their metal component (e.g., less than 25% mol basis) in the $D_{max}$ areas of the image. Preferably the soaps are reduced by less than 10% mol basis in these areas. This defines whether or not the metal soaps are photothermographically reducible or not according to the practice of the present invention. Particular metal soaps evaluated which improved the adhesion of the silver layer to polyester support are magnesium stearate and zinc stearate.

The Photosensitive Silver Halide

As noted above, the present invention includes a photosensitive silver halide in the photothermographic construction. The photosensitive silver halide can be any photosensitive silver halide, such as silver bromide, silver iodide, silver chloride, silver bromoiodide, silver chlorobromoiodide, silver chlorobromide, etc. The photosensitive silver halide can be added to the emulsion layer in any fashion so long as it is placed in catalytic proximity to the organic silver compound which serves as a source of reducible silver.

The silver halide may be in any form which is photosensitive including, but not limited to cubic, octahedral, rhombic dodecahedral, orthrohombic, tetrahedral, other polyhedral habits, etc., and may have epitaxial growth of crystals thereon. Tabular grains are not preferred and are in fact least preferred crystal habits to be used in the photothermographic elements of the present invention. Narrow grain size distributions of truly tabular grains (e.g., with aspect ratios of 5:1 and greater) can not be readily provided by existing techniques with the preferred grain sizes of less than an average diameter size of 0.10 $\mu$m. There are grains referred to in the art as "tabular," "laminar," or "sigma" grains which may have aspect ratios of less than 5:1, such as disclosed in U.S. Pat. No. 4,806,461 which shows "tabular" twinned plane grains called laminar grains with aspect ratios equal to or greater than 2:1 with grain thickness of less than 0.5 $\mu$m and grain diameter averages of less than 0.3, but it is not clear that such grains are within the consideration of the ordinarily skilled artisan as laminar or tabular grains as much as they are merely definitions broadening the coverage of the terms without the conceptual benefits of the original disclosures of tabular grains in providing higher capture surface areas to volume ratios for the silver halide grains (e.g., higher projected areas per coating weight of grains as in U.S. Pat. Nos. 4,425,425 and 4,425,426).

The silver halide grains may have a uniform ratio of halide throughout; they may have a graded halide content, with a continuously varying ratio of, for example, silver bromide and silver iodide; or they may be of the core-shell-type, having a discrete core of one halide ratio, and a discrete shell of another halide ratio. Core-shell type silver halide grains useful in photothermographic elements and methods of preparing these materials are described in allowed U.S. Pat. No. 5,382,504. A core-shell silver halide grain having an iridium doped core is particularly preferred. Iridium doped core-shell grains of this type are described in U.S. Pat. No. 5,434,043.

The silver halide may be prepared ex situ, (i.e., be pre-formed) and mixed with the organic silver salt in a binder prior to use to prepare a coating solution. The silver halide may be pre-formed by any means, e.g., in accordance with U.S. Pat. No. 3,839,049. For example, it is effective to blend the silver halide and organic silver salt using a homogenizer for a long period of time. Materials of this type are often referred to as "pre-formed emulsions." Methods of preparing these silver halide and organic silver salts and manners of blending them are described in *Research Disclosure*, June 1978, item 17029; U.S. Pat. Nos. 3,700,458 and 4,076,539; and Japanese Patent Nos. 13224/74, 42529/76, and 17216/75.

It is desirable in the practice of this invention to use pre-formed silver halide grains of less than 0.10 μm in an infrared sensitized, photothermographic material. Preferably the number average particle size of the grains is between 0.01 and 0.08 μm; more preferably, between 0.03 and 0.07 μm; and most preferably, between 0.04 and 0.06 μm. It is also preferred to use iridium doped silver halide grains and iridium doped core-shell silver halide grains as disclosed in copending U.S. patent application Ser. No. 08/297,598, and U.S. Pat. No. 5,434,043 described above.

Pre-formed silver halide emulsions when used in the material of this invention can be unwashed or washed to remove soluble salts. In the latter case the soluble salts can be removed by chill-setting and leaching or the emulsion can be coagulation washed, e.g., by the procedures described in U.S. Pat. Nos. 2,618,556; 2,614,928; 2,565,418; 3,241,969; and 2,489,341.

It is also effective to use an in situ process, i.e., a process in which a halogen-containing compound is added to an organic silver salt to partially convert the silver of the organic silver salt to silver halide.

The light sensitive silver halide used in the present invention can be employed in a range of about 0.005 mole to about 0.5 mole; preferably, from about 0.01 mole to about 0.15 mole per mole; and more preferably, from 0.03 mole to 0.12 mole per mole of non-photosensitive reducible silver salt.

The silver halide used in the present invention may be chemically and spectrally sensitized in a manner similar to that used to sensitize conventional wet process silver halide or state-of-the-art heat-developable photographic materials. For example, it may be chemically sensitized with a chemical sensitizing agent, such as a compound containing sulfur, selenium, tellurium, etc., or a compound containing gold, platinum, palladium, ruthenium, rhodium, iridium, etc., a reducing agent such as a tin halide, etc., or a combination thereof. The details of these procedures are described in T.H. James *The Theory of the Photographic Process*, Fourth Edition, Chapter 5, pages 149 to 169. Suitable chemical sensitization procedures are also described in Shepard, U.S. Pat. No. 1,623,499; Waller, U.S. Pat. No. 2,399,083; McVeigh, U.S. Pat. No. 3,297,447; and Dunn, U.S. Pat. No. 3,297,446.

Addition of sensitizing dyes to the photosensitive silver halides serves to provide them with high sensitivity to visible and infrared light by spectral sensitization. Thus, the photosensitive silver halides may be spectrally sensitized with various known dyes that spectrally sensitize silver halide. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. Of these dyes, cyanine dyes, merocyanine dyes, and complex merocyanine dyes are particularly useful.

An appropriate amount of sensitizing dye added is generally about $10^{-10}$ to $10^{-1}$ mole; and preferably, about $10^{-8}$ to $10^{-3}$ moles per mole of silver halide.

Supersensitizers

To get the speed of the photothermographic elements up to maximum levels and further enhance infrared sensitivity, it is often desirable to use supersensitizers. Any supersensitizer could be used which increases the infrared sensitivity, but the preferred supersensitizers are described in copending U.S. patent application Ser. No. 08/091,000 and include heteroaromatic mercapto compounds (I) or heteroaromatic disulfide compounds (II)

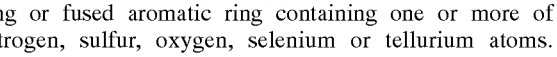

Ar-SM (I)

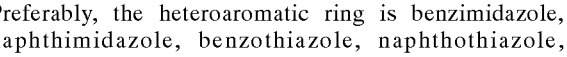

Ar-S-S-Ar (II)

wherein M represents a hydrogen atom or an alkali metal atom.

In supersensitizers (I) and (II), Ar represents an aromatic ring or fused aromatic ring containing one or more of nitrogen, sulfur, oxygen, selenium or tellurium atoms. Preferably, the heteroaromatic ring is benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline or quinazolinone. However, other heteroaromatic rings are envisioned under the breadth of this invention.

The heteroaromatic ring may also carry substituents with examples of preferred substituents being selected from the class consisting of halogen (e.g., Br and Cl), hydroxy, amino, carboxy, alkyl (e.g. of 1 or more carbon atoms, preferably 1 to 4 carbon atoms) and alkoxy (e.g. of 1 or more carbon atoms, preferably of 1 to 4 carbon atoms.

The preferred supersensitizers are 2-mercaptobenzimidazole, 2-mercapto-5-methylbenzimidazole and 2-mercaptobenzothiazole.

The supersensitizers are used in general amount of at least 0.001 moles/mole of silver in the emulsion layer. Usually the range is between 0.001 and 1.0 moles of the compound per mole of silver and preferably between 0.01 and 0.3 moles of compound per mole of silver.

The Non-Photosensitive Reducible Silver Source Material

The non-photosensitive reducible silver source that can be used in the present invention can be any material that contains a source of reducible silver ions. Preferably, it is a silver salt which is comparatively stable to light and forms a silver image when heated to 80° C. or higher in the presence of an exposed photocatalyst (such as silver halide) and a reducing agent.

Silver salts of organic acids, particularly silver salts of long chain fatty carboxylic acids, are preferred. The chains typically contain 10 to 30, preferably 15 to 28, carbon atoms. Suitable organic silver salts include silver salts of organic compounds having a carboxyl group. Examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laureate, silver caprate, silver myristate, silver palmitate, silver maleate, silver fumarate, silver tartarate, silver furoate, silver linoleate, silver butyrate, silver camphorate, and mixtures thereof, etc. Silver salts that can be substituted with a halogen atom or a hydroxyl group also can be effectively used. Preferred examples of the silver salts of aromatic carboxylic acid and other carboxyl group-containing compounds include: silver benzoate, a silver-substituted benzoate, such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc.; silver gallate; silver tannate; silver phthalate; silver terephthalate; silver salicylate; silver phenylacetate; silver pyromellilate; a silver salt of 3-carboxymethyl-4-methyl-4-thiazoline-2-thione or the like as described in U.S. Pat. No. 3,785,830; and a silver salt of an aliphatic carboxylic acid containing a thioether group as described in U.S. Pat. No. 3,330,663.

Silver salts of compounds containing mercapto or thione groups and derivatives thereof can also be used. Preferred examples of these compounds include: a silver salt of 3-mercapto-4-phenyl-1,2,4-triazole; a silver salt of 2-mercaptobenzimidazole; a silver salt of 2-mercapto-5-aminothiadiazole; a silver salt of 2-(2-ethylglycolamido) benzothiazole; a silver salt of thioglycolic acid, such as a silver salt of a S-alkylthioglycolic acid (wherein the alkyl group has from 12 to 22 carbon atoms); a silver salt of a dithiocarboxylic acid such as a silver salt of dithioacetic acid; a silver salt of thioamide; a silver salt of 5-carboxylic-l-methyl-2-phenyl-4-thiopyridine; a silver salt of mercaptotriazine; a silver salt of 2-mercaptobenzoxazole; a silver salt as described in U.S. Pat. No. 4,123,274, for example, a silver salt of a 1,2,4-mercaptothiazole derivative, such as a silver salt of 3-amino-5-benzylthio-1,2,4-thiazole; and a silver salt of a thione compound, such as a silver salt of 3-(2-carboxyethyl)-4-methyl-4-thiazoline-2-thione as disclosed in U.S. Pat. No. 3,201,678.

Silver salts of acetylenes can also be used. Silver acetylides are described in U.S. Pat. Nos. 4,761,361 and 4,775,613.

Furthermore, a silver salt of a compound containing an imino group can be used. Preferred examples of these compounds include: silver salts of benzotriazole and substituted derivatives thereof, for example silver methylbenzotriazole and silver 5-chlorobenzotriazole, etc.; silver salts of 1,2,4-triazoles or 1-H-tetrazoles as described in U.S. Pat. No. 4,220,709; and silver salts of imidazoles and imidazole derivatives.

It is also found convenient to use silver half soaps. A preferred example of a silver half soap is an equimolar blend of silver behenate and behenic acid, which analyzes for about 14.5% silver and which is prepared by precipitation from an aqueous solution of the sodium salt of commercial behenic acid.

Transparent sheet materials made on transparent film backing require a transparent coating. For this purpose a silver behenate full soap, containing not more than about 4 or 5 percent of free behenic acid and analyzing about 25.2 percent silver, can be used.

The method used for making silver soap dispersions is well known in the art and is disclosed in *Research Disclosure*, April 1983, item 22812, *Research Disclosure*, October 1983, item 23419, and U.S. Pat. No. 3,985,565.

The silver halide and the non-photosensitive reducible silver source material that form a starting point of development should be in catalytic proximity, i.e., reactive association. By "catalytic proximity" or "reactive association" is meant that they should be in the same layer, in adjacent layers, or in layers separated from each other by an intermediate layer having a thickness of less than 1 micrometer (1 mm). It is preferred that the silver halide and the non-photosensitive reducible silver source material be present in the same layer.

Photothermographic emulsions containing pre-formed silver halide in accordance with this invention can be sensitized with chemical sensitizers, or with spectral sensitizers as described above.

The source of reducible silver material generally constitutes about 5 to about 70 percent by weight of the emulsion layer. It is preferably present at a level of about 10 to about 50 percent by weight of the emulsion layer.

The Reducing Agent for the Non-Photosensitive Reducible Silver Source

The reducing agent for the organic silver salt may be any material, preferably organic material, that can reduce silver ion to metallic silver. Conventional photographic developers such as phenidone, hydroquinones, and catechol are useful, but hindered bisphenol reducing agents are preferred.

When the photothermographic element used in this invention containing a reducing agent for the non-photosensitive reducible silver source is heat developed, preferably at a temperature of from about 80° C. to about 250° C. (176° F. to 482° F.) for a duration of from about 1 second to about 2 minutes, in a substantially water-free condition after, or simultaneously with, imagewise exposure, a black-and-white silver image is obtained either in exposed areas or in unexposed areas with exposed photosensitive silver halide.

A wide range of reducing agents has been disclosed in dry silver systems including amidoximes, such as phenylamidoxime, 2-thienylamidoxime and p-phenoxyphenylamidoxime; azines, such as 4-hydroxy-3,5-dimethoxybenzaldehydeazine; a combination of aliphatic carboxylic acid aryl hydrazides and ascorbic acid, such as 2,2'-bis(hydroxymethyl)propionyl-b-phenylhydrazide in combination with ascorbic acid; a combination of polyhydroxybenzene and hydroxylamine; a reductone and/or a hydrazine, such as a combination of hydroquinone and bis(ethoxyethyl)hydroxylamine, piperidinohexose reductone, or formyl-4-methylphenylhydrazine; hydroxamic acids, such as phenylhydroxamic acid, p-hydroxyphenylhydroxamic acid, and o-alaninehydroxamic acid; a combination of azines and sulfonamidophenols, such as phenothiazine with p-benzenesulfonamidophenol or 2,6-dichloro-4-benzenesulfonamidophenol; a-cyanophenylacetic acid derivatives, such as ethyl a-cyano-2-methylphenylacetate, ethyl a-cyano-phenylacetate; bis-o-naphthols, such as by 2,2'-dihydroxyl-1-binaphthyl, 6,6'-dibromo-2,2'-dihydroxy-1,1'-binaphthyl, and bis(2-hydroxy-1-naphthyl)methane; a combination of bis-o-naphthol and a 1,3-dihydroxybenzene derivative, such as 2,4-dihydroxybenzophenone or 2,4-dihydroxyacetophenone; 5-pyrazolones such as 3-methyl-1-phenyl-5-pyrazolone; reductones, such as dimethylaminohexose reductone, anhydrodihydroaminohexose reductone, and anhydrodihydro-piperidone-hexose reductone; sulfonamidophemol reducing agents, such as 2,6-dichloro-4-benzenesulfonamidophenol and p-benzenesulfonamidophenol; indane-1,3-diones, such as 2-phenylindane-1,3-dione; chromans, such as 2,2-dimethyl-7-t-butyl-6-hydroxy-chroman; 1,4-dihydropyridines, such as 2,6-dimethoxy-3,5-dicarbethoxy-1,4-dihydropyridine; bisphenols, such as bis(2-hydroxy-3-t-butyl-5-methylphenyl)methane, 1,1-bis(2-hydroxy-3,5-dimethylphenyl)-3,5,5-trimethylhexane, 2,2-bis(4-hydroxy-3-methylphenyl)propane, 4,4-ethylidene-bis(2-t-butyl-6-methylphenol), and 2,2-bis(3,5-dimethyl-4-hydroxyphenyl) propane; ascorbic acid derivatives, such as 1-ascorbylpalmitate, ascorbylstearate; unsaturated aldehydes and ketones; certain 1,3-indanediones, and 3-pyrazolidones (phenidones).

The reducing agent should be present as 1 to 10% by weight of the imaging layer. In multilayer constructions, if the reducing agent is added to a layer other than an emulsion layer, slightly higher proportions, of from about 2 to 15%, tend to be more desirable.

The Optional Dye-Forming or Dye-Releasing Material

The reducing agent for the reducible source of silver may be a compound that can be oxidized directly or indirectly to form or release a dye.

When the photothermographic element used in this invention containing an optional dye-forming or dye-releasing material is heat developed, preferably at a temperature of from about 80° C. to about 250° C. (176° F. to 482° F.) for a duration of from about 1 second to about 2 minutes, in a substantially water-free condition after, or simultaneously with, imagewise exposure, a dye image is obtained simultaneously with the formation of a silver image either in exposed areas or in unexposed areas with exposed photosensitive silver halide.

Leuco dyes are one class of dye-forming material that form a dye upon oxidation. Any leuco dye capable of being oxidized by silver ion to form a visible image can be used in the present invention. Leuco dyes that are both pH sensitive and oxidizable can also be used, but are not preferred. Leuco dyes that are sensitive only to changes in pH are not included within scope of dyes useful in this invention because they are not oxidizable to a colored form.

As used herein, a "leuco dye" or "blocked leuco dye" is the reduced form of a dye that is generally colorless or very lightly colored and is capable of forming a colored image upon oxidation of the leuco or blocked leuco dye to the dye form. Thus, the blocked leuco dyes (i.e., blocked dye-releasing compounds), absorb less strongly in the visible region of the electromagnetic spectrum than do the dyes. The resultant dye produces an image either directly on the sheet on which the dye is formed or, when used with a dye- or image-receiving layer, on the image-receiving layer upon diffusion through emulsion layers and interlayers.

Representative classes of leuco dyes that can used in the photothermographic elements of the present invention include, but are not limited to: chromogenic leuco dyes, such as indoaniline, indophenol, or azomethine leuco dyes; imidazole leuco dyes, such as 2-(3,5-di-t-butyl-4-hydroxyphenyl)-4,5-diphenylimidazole, as described in U.S. Pat. No. 3,985,565; dyes having an azine, diazine, oxazine, or thiazine nucleus such as those described in U.S. Pat. Nos. 4,563,415; 4,622,395; 4,710,570; and 4,782,010; and benzylidene leuco compounds as described in U.S. Pat. No. 4,923,792.

Another preferred class of leuco dyes useful in this invention are those derived from azomethine leuco dyes or indoaniline leuco dyes. These are often referred to herein as "chromogenic leuco dyes" because many of these dyes are useful in conventional, wet-processed photography. Chromogenic dyes are prepared by oxidative coupling of a p-phenylenediamine compound or a p-aminophenol compound with a photographic-type coupler. Reduction of the corresponding dye as described, for example, in U.S. Pat. No. 4,374,921 forms the chromogenic leuco dye. Leuco chromogenic dyes are also described in U.S. Pat. No. 4,594,307. Cyan leuco chromogenic dyes having short chain carbamoyl protecting groups are described in European Laid Open Patent Application No. 533,008. For a review of chromogenic leuco dyes, see K. Venkataraman, *The Chemistry of Synthetic Dyes*, Academic Press: New York, 1971; Vol. 4, Chapter VI.

Another class of leuco dyes useful in this invention are "aldazine" and "ketazine" leuco dyes. Dyes of this type are described in U.S. Pat. Nos. 4,587,211 and 4,795,697. Benzylidene leuco dyes are also useful in this invention. Dyes of this type are described in U.S. Pat. No. 4,923,792.

Yet another class of dye-releasing materials that form a diffusible dye upon oxidation are known as pre-formed-dye-release (PDR) or redox-dye-release (RDR) materials. In these materials, the reducing agent for the organic silver compound releases a mobile preformed dye upon oxidation. Examples of these materials are disclosed in Swain, U.S. Pat. No. 4,981,775.

Further, as other image-forming materials, materials where the mobility of the compound having a dye part changes as a result of an oxidation-reduction reaction with silver halide, or an organic silver salt at high temperature can be used, as described in Japanese Patent No. 165,054/84.

Still further the reducing agent may be a compound that releases a conventional photographic dye coupler or developer on oxidation as is known in the art.

The dyes formed or released in the various colorforming layers should, of course, be different. A difference of at least 60 nm in reflective maximum absorbance is preferred. More preferably, the absorbance maximum of dyes formed or released will differ by at least 80–100 nm. When three dyes are to be formed, two should preferably differ by at least these minimums, and the third should preferably differ from at least one of the other dyes by at least 150 nm, and more preferably, by at least 200 nm. Any reducing agent capable of being oxidized by silver ion to form or release a visible dye is useful in the present invention as previously noted.

The total amount of optional leuco dye used as a reducing agent used in the present invention should preferably be in the range of 0.5–25 weight percent, and more preferably, in the range of 1–10 weight percent, based upon the total weight of each individual layer in which the reducing agent is employed.

The Binder

The photosensitive silver halide, the non-photosensitive reducible source of silver, the reducing agent, and any other addenda used in the present invention are generally added to at least one binder.

The binder(s) that can be used in the present invention can be employed individually or in combination with one another. It is preferred that the binder be selected from polymeric materials, such as, for example, natural and synthetic resins that are sufficiently polar to hold the other ingredients in solution or suspension.

A typical hydrophilic binder is a transparent or translucent hydrophilic colloid. Examples of hydrophilic binders include: a natural substance, for example, a protein such as gelatin, a gelatin derivative, a cellulose derivative, etc.; a polysaccharide such as starch, gum arabic, pullulan, dextrin, etc.; and a synthetic polymer, for example, a water-soluble polyvinyl compound such as polyvinyl alcohol, polyvinyl pyrrolidone, acrylamide polymer, etc. Another example of a hydrophilic binder is a dispersed vinyl compound in latex form which is used for the purpose of increasing dimensional stability of a photographic element.

Examples of typical hydrophobic binders are polyvinyl acetals, polyvinyl chloride, polyvinyl acetate, cellulose acetate, polyolefins, polyesters, polystyrene, polyacrylonitrile, polycarbonates, methacrylate copolymers, maleic anhydride ester copolymers, butadiene-styrene copolymers, and the like. Copolymers, e.g., terpolymers, are also included in the definition of polymers. The polyvinyl acetals, such as polyvinyl butyral and polyvinyl formal, and vinyl copolymers such as polyvinyl acetate and polyvinyl chloride are particularly preferred.

Although the binder can be hydrophilic or hydrophobic, preferably it is hydrophobic in the silver containing layer(s). optionally, these polymers may be used in combination of two or more thereof.

The binders are preferably used at a level of about 30–90 percent by weight of the emulsion layer, and more preferably at a level of about 45–85 percent by weight. Where the proportions and activities of the reducing agent for the non-photosensitive reducible source of silver require a particular developing time and temperature, the binder should be able to withstand those conditions. Generally, it is preferred that the binder not decompose or lose its structural integrity at 250° F. (121° C.) for 60 seconds, and more preferred that it not decompose or lose its structural integrity at 350° F. (177° C.) for 60 seconds.

The polymer binder is used in an amount sufficient to carry the components dispersed therein, that is, within the effective range of the action as the binder. The effective range can be appropriately determined by one skilled in the art.

Photothermographic Formulations

The formulation for the photothermographic emulsion layer can be prepared by dissolving and dispersing the binder, the photosensitive silver halide, the non-photosensitive reducible source of silver, the reducing agent for the non-photosensitive reducible silver source, and optional additives, in an inert organic solvent, such as, for example, toluene, 2-butanone, or tetrahydrofuran.

The use of "toners" or derivatives thereof which improve the image, is highly desirable, but is not essential to the element. Toners can be present in an amount of about 0.01–10 percent by weight of the emulsion layer, preferably about 0.1–10 percent by weight. Toners are well known materials in the photothermographic art, as shown in U.S. Pat. Nos. 3,080,254; 3,847,612; and 4,123,282.

Examples of toners include: phthalimide and N-hydroxyphthalimide; cyclic imides, such as succinimide, pyrazoline-5-ones, quinazolinone, 1-phenylurazole, 3-phenyl-2-pyrazoline-5-one, and 2,4-thiazolidinedione; naphthalimides, such as N-hydroxy-1,8-naphthalimide; cobalt complexes, such as cobaltic hexamine trifluoroacetate; mercaptans such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboximides, such as (N,N-dimethylaminomethyl)phthalimide, and N-(dimethylaminomethyl)naphthalene-2,3-dicarboximide; a combination of blocked pyrazoles, isothiuronium derivatives, and certain photobleach agents, such as a combination of N,N'-hexamethylene-bis(1-carbamoyl-3,5-dimethylpyrazole), 1,8-(3,6-diaza-octane)bis(isothiuronium)trifluoroacetate, and 2-(tribromomethylsulfonyl benzothiazole); merocyanine dyes such as 3-ethyl-5-[(3-ethyl-2-benzothiazolinylidene)-1-methyl-ethylidene]-2-thio-2,4-o-azolidinedione; phthalazinone, phthalazinone derivatives, or metal salts or these derivatives, such as 4-(l-naphthyl)phthalazinone, 6-chlorophthalazinone, 5,7-dimethoxyphthalazinone, and 2,3-dihydro-1,4-phthalazinedione; a combination of phthalazine plus one or more phthalic acid derivatives, such as phthalic acid, 4-methylphthalic acid, 4-nitrophthalic acid, and tetrachlorophthalic anhydride, quinazolinediones, benzoxazine or naphthoxazine derivatives; rhodium complexes functioning not only as tone modifiers but also as sources of halide ion for silver halide formation in situ, such as ammonium hexachlororhodate (III), rhodium bromide, rhodium nitrate, and potassium hexachlororhodate (III); inorganic peroxides and persulfates, such as ammonium peroxydisulfate and hydrogen peroxide; benzoxazine-2,4-diones, such as 1,3-benzoxazine-2,4-dione, 8-methyl-1,3-benzoxazine-2,4-dione, and 6-nitro-1,3-benzoxazine-2,4-dione; pyrimidines and asymtriazines, such as 2,4-dihydroxypyrimidine, 2-hydroxy-4-aminopyrimidine, and azauracil; and tetrazapentalene derivatives, such as 3,6-dimercapto-1,4-diphenyl- 1H,4H-2,3a,5,6a-tetraazapentalene and 1,4-di-(o-chlorophenyl)-3,6-dimercapto-1H,4H-2,3a,5,6a-tetra-azapentalene.

The photothermographic elements used in this invention can be further protected against the additional production of fog and can be stabilized against loss of sensitivity during storage. While not necessary for the practice of the invention, it may be advantageous to add mercury (II) salts to the emulsion layer(s) as an antifoggant. Preferred mercury (II) salts for this purpose are mercuric acetate and mercuric bromide.

Other suitable antifoggants and stabilizers, which can be used alone or in combination, include the thiazolium salts described in U.S. Pat. No. 2,131,038 and U.S. Pat. No. 2,694,716; the azaindenes described in U.S. Pat. No. 2,886,437; the triazaindolizines described in U.S. Pat. No. 2,444,605; the mercury salts described in U.S. Pat. No. 2,728,663; the urazoles described in U.S. Pat. No. 3,287,135; the sulfocatechols described in U.S. Pat. No. 3,235,652; the oximes described in British Pat. No. 623,448; the polyvalent metal salts described in U.S. Pat. No. 2,839,405; the thiuronium salts described in U.S. Pat. No. 3,220,839; and palladium, platinum and gold salts described in U.S. Pat. Nos. 2,566,263 and 2,597,915.

Photothermographic elements of the invention can contain plasticizers and lubricants such as polyalcohols and diols of the type described in U.S. Pat. No. 2,960,404; fatty acids or esters, such as those described in U.S. Pat. Nos. 2,588,765 and 3,121,060; and silicone resins, such as those described in British Patent No. 955,061.

The photothermographic elements of the present invention can also include image dye stabilizers. Such image dye stabilizers are illustrated by U.K. Patent No. 1,326,889; and U.S. Pat. Nos. 3,432,300; 3,698,909; 3,574,627; 3,573,050; 3,764,337; and 4,042,394.

Photothermographic elements according to the present invention can further contain light-absorbing materials, antihalation, acutance, and filter dyes such as those described in U.S. Pat. Nos. 3,253,921; 2,274,782; 2,527,583; 2,956,879, 5,266,452, and 5,314,795. If desired, the dyes can be mordanted, for example, as described in U.S. Pat. No. 3,282,699. In addition to the particles used in the present invention for optical effects, the photothermographic elements according to the present invention can also contain matting agents such as starch, titanium dioxide, zinc oxide, silica, and polymeric beads including beads of the type described in U.S. Pat. Nos. 2,992,101 and 2,701,245.

Furthermore they can also contain antistatic or conducting layers, such as layers that comprise soluble salts, e.g., chlorides, nitrates, etc., evaporated metal layers, ionic polymers such as those described in U.S. Pat. Nos. 2,861,056 and 3,206,312 or insoluble inorganic salts such as those described in U.S. Pat. No. 3,428,451.

Photothermographic Constructions

The photothermographic elements of this invention can be constructed of one or more layers on a support. Single layer constructions should contain the silver halide, the non-photosensitive, reducible silver source material, the reducing agent for the non-photosensitive reducible silver source, the binder as well as optional materials such as toners, dye-forming or dye-releasing materials, coating aids, and other adjuvants.

Two-layer constructions should contain silver halide and non-photosensitive, reducible silver source in one emulsion layer (usually the layer adjacent to the support) and some of the other ingredients in the second layer or both layers, although two layer constructions comprising a single emulsion layer coating containing all the ingredients and a protective topcoat are envisioned. Multicolor photothermographic dry silver constructions can contain sets of these bilayers for each color or they can contain all ingredients within a single layer, as described in U.S. Pat. No. 4,708,928. In the case of multilayer, multicolor photothermographic elements, the various emulsion layers are generally maintained distinct from each other by the use of functional or non-functional barrier layers between the various photosensitive layers, as described in U.S. Pat. No. 4,460,681.

Barrier layers, preferably comprising a polymeric material, can also be present in the photothermographic element of the present invention. Polymers for the material of the barrier layer can be selected from natural and synthetic polymers such as gelatin, polyvinyl alcohols, polyacrylic acids, sulfonated polystyrene, and the like. The polymers can optionally be blended with barrier aids such as silica.

Alternatively, the formulation can be spray-dried or encapsulated to produce solid particles, which can then be redispersed in a second, possibly different, binder and then coated onto the support. The formulation for the emulsion layer can also include coating aids such as fluoroaliphatic polyesters.

Photothermographic emulsions used in this invention can be coated by various coating procedures including wire wound rod coating, dip coating, air knife coating, curtain coating, or extrusion coating using hoppers of the type described in U.S. Pat. No. 2,681,294. If desired, two or more layers can be coated simultaneously by the procedures described in U.S. Pat. No. 2,761,791 and British Patent No. 837,095. Typical wet thickness of the emulsion layer can be about 10–150 micrometers ($\mu$m), and the layer can be dried in forced air at a temperature of about 20–100° C. It is preferred that the thickness of the layer be selected to provide maximum image densities greater than 0.2, and, more preferably, in the range 0.5 to 4.0, as measured by a MacBeth Color Densitometer Model TD 504 using the color filter complementary to the dye color.

Additionally, it may be desirable in some instances to coat different emulsion layers on both sides of a transparent support, especially when it is desirable to isolate the imaging chemistries of the different emulsion layers as disclosed in U.S. Pat. No. 5,264,321.

Development conditions will vary, depending on the construction used, but will typically involve heating the imagewise exposed material at a suitably elevated temperature. When used in a photothermographic element, the latent image obtained after exposure of the heat-sensitive construction can be developed by heating the material at a moderately elevated temperature of, for example, about 80–250° C., preferably about 100–200° C., for a sufficient period of time, generally about 1 second to about 2 minutes. Heating may be carried out by the typical heating means such as a hot plate, an iron, a hot roller, a heat generator using carbon or titanium white, or the like.

In some methods, the development is carried out in two steps. Thermal development takes place at a higher temperature, e.g., about 150° C. for about 10 seconds, followed by thermal diffusion at a lower temperature, e.g., about 80° C., in the presence of a transfer solvent. The second heating step at the lower temperature prevents further development and allows the dyes that are already formed to diffuse out of the emulsion layer to the receptor layer.

The Support

Photothermographic emulsions used in the invention can be coated on a wide variety of supports. The support (also known as the substrate) can be selected from a wide range of materials depending on the imaging requirement. Supports may be transparent or at least translucent. Typical supports include polyester film, subbed polyester film (e.g., polyethylene terephthalate or polyethylene naphthalate film), cellulose acetate film, cellulose ester film, polyvinyl acetal film, polyolefinic film (e.g., polethylene or polypropylene or blends thereof), polycarbonate film and related or resinous materials, as well as glass, paper, and the like. Typically, a flexible support is employed, especially a polymeric film support, which can be partially acetylated or coated, particularly with a polymeric subbing or priming agent. Preferred polymeric materials for the support include polymers having good heat stability, such as polyesters. Particularly preferred polyesters are polyethylene terephthalate and polyethylene naphthalate.

A support with a backside resistive heating layer can also be used photothermographic imaging systems such as shown in U.S. Pat. No. 4,374,921.

Use as a Photomask

As noted above, the possibility of low absorbance of the photothermographic element at 380 nm in non-imaged areas facilitates the use of the photothermographic elements of the present invention in a process where there is a subsequent exposure of an ultraviolet radiation sensitive imageable medium. For example, imaging the photothermographic element and subsequent development affords a visible image. The developed photothermographic element absorbs ultraviolet radiation in the areas where there is a visible image and transmits ultraviolet radiation where there is no visible image. The developed element may then be used as a mask and placed between an ultraviolet radiation energy source and an ultraviolet radiation photosensitive imageable medium such as, for example, a photopolymer, diazo material, or photoresist. This process is particularly useful where the imageable medium comprises a printing plate and the photothermographic element serves as an imagesetting film.

Reasonable modifications and variations are possible from the foregoing disclosure without departing from either the spirit or scope of the invention as defined by the claims. Objects and advantages of this invention will now be illustrated by the following examples, but the particular materials and amounts thereof recited in these examples, as well as other conditions and details, should not be construed to unduly limit this invention.

EXAMPLES

All materials used in the following examples were readily available from standard commercial sources such as Aldrich Chemical Co. (Milwaukee, Wis.) unless otherwise specified. The following additional terms and materials were used.

Acryloid™ A-21 is an acrylic copolymer available from Rohm and Haas,Philadelphia, Pa.

Butvar™ B-79 is a polyvinyl butyral resin available from Monsanto Company, St. Louis, Mo.

CAB 171-15S is a cellulose acetate butyrate resin available form Eastman Kodak Co.

Desmodur™ N3300 is an aliphatic triisocyanate available from Mobay Chemicals, Pittsburgh, Pa.

Gelva™ V1.5 is a polyvinyl acetate resin available from Monsanto Company, St. Louis, Mo.

MEK is methyl ethyl ketone (2-butanone).

MR-60 is a polyketone resin available from Mohawk.

Permanax™ WSO is 1,1-bis(2-hydroxy-3,5-dimethylphenyl)-3,5,5-trimethylhexane [CAS RN=7292-14-0] and is available from Vulnax International Ltd. It is also known as Nonox.

PE-2200 is a polyester resin available from Shell.

PET is polyethylene terephthalate.

Dye-1 has the structure shown below. Its preparation is disclosed in allowed U.S. Pat. No. 5,441,866.

Dye-1

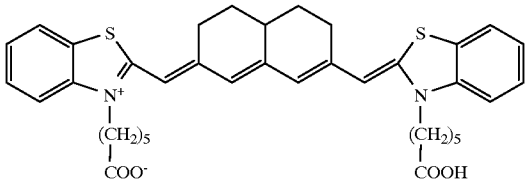

Dye-2 has the structure shown below. Its preparation is disclosed in European Laid Open Patent Application No. 0 616 014 A2.

Dye-2

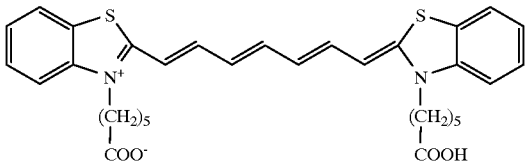

2-(tribromomethylsulphonyl)quinoline has the following structure:

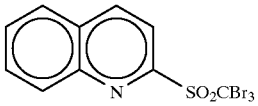

Fluorinated terpolymer A has the following random polymer structure, where m=7, n=2 and p=1. The preparation of fluorinated terpolymer A is described in U.S. Pat. No. 5,380,644.

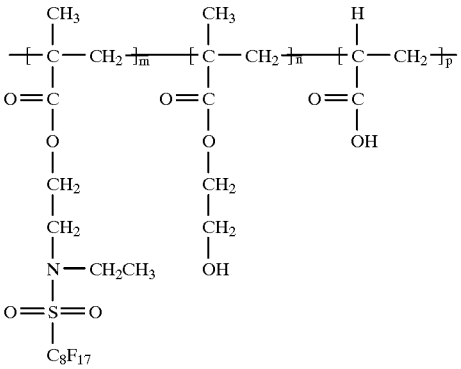

Examples 1–4

As noted above, the adhesion of a coated emulsion layer of the photothermographic element to a support is significantly improved by the addition of an "adhesion promoting resin" or a metal soap to the silver containing emulsion layer (i.e., the first layer adjacent to the support) coating layer formulation.

The "adhesion promoting resin" is a resin which meets the following two criteria:

1. When coated from solvent on plain polyester the resin adheres to the support more strongly than polyvinyl butyral (if that is the primary binder in the silver halide containing layer), and 2. When coated as a blend with polyvinyl butyral (again if this is the primary binder for the silver halide containing layer) from solvent on plain polyester, the resin blend adheres to the support more strongly than does the polyvinyl butyral.

To identify resins meeting criterion 1 with respect to polyvinyl butyral, over one hundred resins from twenty-five resin classes were solvent coated on polyester and the adhesion of the resulting film compared to the adhesion of polyvinyl butyral. The classes of resins evaluated were: acrylic, cellulose acetate, cellulose acetate butyrate, cellulose acetate propionate, ethyl cellulose, nitrocellulose, hydroxy propyl cellulose, polyamide, polycaprolactone, polyester, polyketone, polystyrene, polystyrene copolymers (styrene acrylonitrile, styrene maleic anhydride, styrene butadiene), polyvinyl toluene, polyurethane, polyvinyl acetal, polyvinyl butyral, polyvinyl acetate, polyvinyl chloride co- and terpolymers, polyvinyl pyrrolidone, polyvinyl pyrrolidone/vinyl acetate copolymers, chlorinated rubber, phenoxy resins, polyimide and epoxy resins. Resins from the following classes exhibited adhesion to polyester greater than polyvinyl butyral: acrylics, cellulose acetate butyrate, polyamide, polyanhydrides, polyesters, polyketones, polystyrene copolymers, vinyl toluene copolymers, polyvinyl acetate, polyvinyl pyrrolidone/vinyl acetate copolymers, chlorinated rubber and polyimide.

To identify resins meeting criterion 2, a solution of polyvinyl butyral was mixed with a solution of each resin which met criterion 1, the resin blend was coated on polyester, and the adhesion of the resulting film compared to the adhesion of a polyvinyl butyral film. Resins meeting this criterion are: cellulose acetate butyrate (CAB 551-0.2, Eastman Chemicals), polyester (Vitel PE-22000, PE-2700, Shell), polyketone (K-3886, K-1717B, MR-60, Mohawk, Union Carbide 252), styrene-butadiene (Pliolite S5A, Goodyear), vinyl toluene-butadiene (Pliolite VT, Goodyear), polyvinyl acetate (AYAC, Union Carbide, Gelva™ V1.5, Monsanto) and polyvinyl pyrrolidone/vinyl acetate (PVP/VA E-335, GAF).

Particular metal soaps evaluated which improved the adhesion of the silver layer to polyester were magnesium stearate and zinc stearate.

Example 1

The following example illustrates the adhesion of resins to polyester (Criterion 1).

Solutions of Butvar™ B-79 polyvinyl butyral resin (Monsanto), Vitel PE-2200 polyester resin (Shell), Gelva™ V1.5 polyvinyl acetate resin (Monsanto), MR-60 polyketone resin (Mohawk), Acryloid B-66 acrylic resin (Rohm & Haas) and Styron 685D polystyrene resin (Dow) were prepared by dissolving the resin in a suitable solvent. The composition of each solution is listed in column 2 of Table 1. Each solution was coated at 2.5 mil (0.06 mm) wet thickness on 7 mil (0.18 mm) polyester film and dried at 77° C. to 82° C. (170 to 180° F.) for three minutes.

The resin layer-to-support adhesion for each sample was determined according to Method B of ASTM D3359-92a, "Standard Test Methods for Measuring Adhesion by Tape Test" using a 2 mm cross-cut tester (Byk-Gardner) and 3M #610 tape (available from 3M Company, St. Paul. Minn.). This test assesses the adhesion of a coating to a support and classifies the adhesion on a zero to five scale, where zero is the poorest adhesion and 5 is the best adhesion. The results, shown below in Table 1, demonstrate that certain resins adhere more strongly than polyvinyl butyral to a polyester support.

TABLE 1

| Ex. | Resin | Coating Solution | Cross-cut Adhesion Classification ASTM D3359-92a | Meets Criterion 1 |
|---|---|---|---|---|
| 1a | Butvar ™ B-79 | 20% Resin<br>75% MEK<br>0.9% Toluene<br>4.1% Methanol | 0 | Control |
| 1b | Vitel PE-2200 | 20% Resin<br>80% MEK | 1 | Yes |
| 1c | Gelva ™ V1.5 | 15% Resin<br>75% MEK<br>10% Ethanol | 5 | Yes |
| 1d | MR-60 Poly-ketone | 10% Resin<br>81% MEK<br>9% Ethanol | 2 | Yes |
| 1e | Acryloid B-66 | 25% Resin<br>75% MEK | 4 | Yes |
| 1f | Styron 685D | 15% Resin<br>85% MEK | 0 | No |

Example 2

The following example illustrates the adhesion of resin/Butvar™ B-79 blends to polyester (Criterion 2). Resins meeting Criterion 1 from Table 1 were blended with Butvar™ B-79 by mixing a 20% resin solution in methyl ethyl ketone with the Butvar™ B-79 solution listed in Table 1. The proportion of each resin solution is listed in Table 2 below. The resulting solutions were coated at 2.5 mil (0.06 mm) wet thickness on 7 mil (0.18 mm) polyester and dried at 170–180° F. for three minutes. The resin layer-to-support adhesion for each sample was determined in the same manner as in Example 1. In this case the adhesion classification of each sample based on the ASTM D3359-92a test method was zero even though there were obvious differences in adhesion between the various samples. Therefore an adhesion classification was used where the amount of film peel resistance was subjectively compared to that of the control Butvar™ B-79 film. These results are listed in Table 2.

TABLE 2

| Resin Solution Blended with Butvar ™ B-79 Solution | Grams resin solution/ grams Butvar ™ B-79 Solution | Crosscut Adhesion Classi-fication | Film Peel Resistance Compared to Butvar ™ B-79 | Meets Criterion 2 |
|---|---|---|---|---|
| None (Control) | — | 0 | control | Control |
| Vitel PE-2200 | 10/90 | 0 | greater | Yes |
| Gelva ™ V-1.5 | 10/90 | 0 | greater | Yes |
| MR-60 | 30/70 | 0 | greater | Yes |
| Acryloid B-66 | 30/70 | 0 | equal | No |

Example 3

The following example illustrates the use of adhesion promoting resins added to the photothermographic silver emulsion layer. Resins meeting Criteria 1 and 2 above improve the adhesion of the photothermographic silver emulsion layer to the polyester support as is illustrated in the following examples.

Preparation of Pre-Formed Core-Shell Silver Iodobromide Emulsion:

A pre-formed core-shell silver iodobromide emulsion was prepared by the method described in U.S. Pat. No. 5,382,504 and incorporated herein by reference. The pre-formed silver soap contained 2.0% by weight of a 0.05 mm diameter core-shell silver iodobromide emulsion (25% core containing 8% iodide, 92% bromide; and 75% all-bromide shell).

Homogenization of Pre-formed Soaps (Homogenate):

A pre-formed silver fatty acid salt homogenate was prepared by homogenizing the following ingredients:

| | |
|---|---|
| Methyl ethyl ketone | 76.0 g |
| Toluene | 1.0 g |
| Butvar ™ B-79 | 2.2 g |
| Pre-formed core-shell silver salt dispersion | 20.8 g |

The ingredients above were mixed at 21° C. for 10 minutes and held for 24 hours. The mixture was homogenized at 4000 psi and then again at 8000 psi.

Photothermographic silver emulsion coating solution:

| | |
|---|---|
| Homogenate | 513.1 g |
| Pyridinium hydrobromide perbromide (15% by weight in methanol) | 2.48 g |
| Calcium bromide (15% by weight in methanol | 3.79 g |
| 2-Mercapto-5-methylbenzimidazole | 0.35 g |
| 2-(3-Chlorobenzolyl)benzoic acid | 3.91 g |
| Dye-1 | 0.073 g |
| Methanol | 16.07 g |
| Butvar ™ B-79 | 124.01 g |
| 2-(Tribromomethylsulphonyl)quinoline (8% by weight in MEK) | 37.89 g |
| Permanax ™ WSO | 29.15 g |
| Desmodur ™ N3300 diisocyanate (66.7% by weight in MEK) | 2.35 g |
| Tetrachlorophthalic acid (26% by weight in MEK) | 3.70 g |
| Phthalazine (22% by weight in MEK) | 13.13 g |

The first two ingredients listed above were mixed at 21° C. for 60 minutes. Calcium bromide was added and the mixture was allowed to stir an additional 30 minutes, followed by the addition of the imidazole, benzoic acid, dye, and methanol. After mixing 30 minutes, the dispersion was cooled to 10° C. The Butvar™ and 2-(tribromomethylsulphonyl)quinoline were then added and the dispersion mixed for 30 minutes. Each of the remaining ingredients were added individually with 15 minute mixing intervals.

The following four examples (3A, 3B, 3C and 3D) were prepared by adding 40.0 g of the above photothermographic silver emulsion coating solution to the corresponding resin:

| | | |
|---|---|---|
| Example 3A | No resin added | 0.00 g |
| Example 3B | Vitel PE-2200 (35% in MEK) | 2.06 g |
| Example 3C | Gelva ™ V1.5 (35% in MEK) | 2.06 g |

-continued

| | | |
|---|---|---|
| Example 3D | MR-60 (50% in MEK) | 2.88 g |

Topcoat solution:

A topcoat solution was prepared by mixing the following ingredients in order:

| | |
|---|---|
| Methanol | 10.68 g |
| Methyl ethyl ketone (MEK) | 81.07 g |
| Tetrachlorophthalic anhydride | 0.06 g |
| CAB 171-15S (Cellulose acetate butyrate) | 7.14 g |
| Fluorinated Terpolymer A (16% by weight in MEK) | 0.50 g |
| Acryloid ™ A-21 (acrylic copolymer) | 0.27 g |
| 4-Methylphthalic acid | 0.27 g |

Each of the Examples 3A-D was dual coated (tandem or consecutive coated in a single trip) with the topcoat solution on 7 mil (0.18 mm) polyester. The photothermographic silver emulsion orifice was set at 3.7 to 4.0 mil (0.09 to 0.10 mm) and the topcoat solution orifice was set to 5.2 to 5.5 mil (0.13 to 0.14 mm). The coatings were dried for 3 minutes at 82° C. (180° F.).

The samples were exposed to an infrared laser sensitometer containing an 811 nm laser diode and developed for 15 seconds at 124° C. (255° F.). The sensitometric wedges were scanned and analyzed on a computer densitometer. The initial sensitometric data are shown below in Table 3.

TABLE 3

| Example | Dmin | Dmax | Speed* | Contrast** |
|---|---|---|---|---|
| 3A | 0.23 | 4.35 | 1.83 | 4.71 |
| 3B | 0.22 | 4.19 | 1.78 | 4.34 |
| 3C | 0.22 | 4.37 | 1.78 | 4.50 |
| 3D | 0.24 | 4.19 | 1.77 | 3.81 |

*Speed = −Log E + 4 corresponding to a density of 1.00 above Dmin (Energy in ergs/cm$^2$)

**Contrast = The slope of the line joining the density points of 0.60 and 2.00 above Dmin The resin layer-to-support adhesion in the Dmax image area for each sample was determined according to method B of ASTM D3359-92a, "Standard Test Methods for Measuring Adhesion by Tape Test" using a 2 mm cross-cut tester (Byk-Gardner) and 3M #610 tape (available from 3M Corporation, St. Paul, Minn.). The results are shown below in Table 4.

TABLE 4

| Example | Dmax Cross-Cut Adhesion Classification ASTM D3359-92a |
|---|---|
| 3A | 0 |
| 3B | 3 |
| 3C | 1 |
| 3D | 4 |

Example 4

The following example illustrates adhesion improvement using zinc stearate.

Homogenization of Pre-formed Soaps (Homogenate):

A pre-formed silver fatty acid salt homogenate was prepared by homogenizing the following ingredients:

| | |
|---|---|
| Methyl ethyl ketone | 79.5 g |
| Toluene | 1.0 g |
| Butvar ™ B-79 | 1.9 g |
| Core-shell pre-formed silver salt dispersion | 17.6 g |

The ingredients above were mixed at 21° C. for 10 minutes and held for 24 hours. The mixture was homogenized at 4000 psi and then again at 8000 psi.

Photothermographic Silver Emulsion Coating Solution:

| | |
|---|---|
| Hamogenate | 70.85 g |
| Pyridinium hydrobromide perbromide (18% by weight in methanol) | 0.44 g |
| Calcium bromide (15% by weight in methanol | 0.43 g |
| Butvar ™ B-79 | 15.46 g |
| 2-(Tribromomethysulphonyl)quinoline-Antifoggant A-(8% by weight in MEK) | 4.25 g |
| Permanax ™ | 2.93 g |
| Desmodur ™ N3300 triisocyanate (66.7% by weight in MEK) | 0.30 g |
| Tetrachlorophthalic acid (26% by weight in MEK) | 0.47 g |
| 2-Mercapto-5-methylbenzimidazole | 0.05 g |
| 2-(3-Chlorobenzolyl)benzoic acid | 0.55 g |
| Dye-2 | 0.001 g |
| Methanol | 2.72 g |
| Phthalazine (24% by weight in MEK) | 1.53 g |

The first two ingredients listed above were mixed at 10° C. for 120 minutes. Calcium bromide was added and the mixture was allowed to stir an additional 30 minutes, followed by the addition of ButvarÔ B-79, and Antifoggant A. Permanax™, Desmodur™ N3300 triisocyanate, and tetrachlorophthalic acid were added individually with 15 minute mixing intervals. After mixing for 30 minutes, the dispersion was held at 10° C. for 16 hours. 2-(3-Chlorobenzolyl)benzoic, Dye-2, and methanol. This emulsion coating dispersion was used in Example 4a.

A zinc stearate dispersion was prepared by homogenizing a dispersion of 71.74 parts of methyl ethyl ketone, 10.76 parts of toluene, 1.68 parts of Butvarb™ B-79 and 15.82 parts of zinc stearate.

A photothermographic silver emulsion coating dispersion was prepared by combining 50.0 g of silver emulsion coating dispersion from above with 5.27 g of the zinc stearate dispersion. This emulsion coating dispersion was used in Example 4b.

Topcoat solution:

A topcoat solution was prepared by mixing the following ingredients in order:

| | |
|---|---|
| Methanol | 10.69 g |
| Methyl ethyl ketone (MEK) | 80.88 g |
| Tetrachlorophthalic anhydride | 0.13 g |
| CAB 171-15S (Cellulose acetate butyrate) | 7.06 g |
| Fluorinated Terpolymer A (16% by weight in MEK) | 0.49 g |
| Acryloid ™ A-21 (acrylic copolymer) | 0.27 g |
| 4-Methyl phthalic acid | 0.30 g |
| Super-Pflex 200 (calcium carbonate, available from Specialty Minerals Inc.) | 0.17 g |

Emulsion coating dispersion, Example 4a (control), and topcoat solution were dual coated on 7 mil (0.18 mm) polyester at a wet thickness of 4.2 mil (0.11 mm) and 5.6 mil (0.14 mm), respectively, and dried for 3 minutes at 82° C. (180° F.).

Emulsion coating dispersion, Example 4a (of this invention), Example 4b, and topcoat solution were dual coated on 7 mil (0.18 mm) polyester at a wet thickness of 4.6 mil (0.12 mm) and 6.0 mil (0.15 mm), respectively, and dried for 3 minutes at 82° C. (180° F.).

Each coated film was exposed to an infrared laser sensitometer containing an 811 nm laser diode and developed by heating to 124° C. (255° F.) for 15 seconds. The silver layer to support adhesion in the Dmax region for each sample was determined according to method B of ASTM D3359-92a test method using a 2 mm cross-cut tester (Byk-Gardner) and 3M #610 tape (available from 3M Corporation, St. Paul, Minn.).

TABLE 5

| Example | Dmax Cross-Cut Adhesion Classification ASTM D3359-92a |
|---|---|
| 4A | 0 |
| 4B | 1 |

Reasonable modifications and variations are possible from the foregoing disclosure without departing from either the spirit or scope of the present invention as defined by the claims.

What is claimed is:

1. A spectrally sensitized photothermographic silver halide element comprising a polyester support having directly coated thereon a photothermographic emulsion layer comprising a polyvinyl acetal binder, a light insensitive silver source, a reducing agent for silver ion, and radiation sensitive silver halide grains, wherein said photothermographic emulsion layer further comprises adhesion promoting materials selected from the group consisting of a) an adhesion promoting resin selected from the group consisting of cellulose acetate butyrate, polyesters, styrene-butadiene, vinyl toluenebutadiene, polyketone, and polyvinyl pyrrolidone/vinyl acetate, and b) particulate metal soap other than a silver soap, which particulate metal soap derived from Group I or Group II metals does not oxidize as part of an imaging photothermographic process in said element.

2. The element of claim 1 wherein said silver halide grains are pre-formed silver halide grains which have a number average particle size of <0.10 $\mu$m where at least 80% of all grains are within ±0.05 $\mu$m of the average.

3. The element of claim 1 wherein said photothermographic emulsion layer comprises particles selected from the group consisting of particles of said adhesion promoting resin and particles of metal soaps of carboxylic acids, said particles having a number average size of 0.5 to 12 $\mu$m.

4. The element of claim 3 wherein said particles of adhesion promoting resin are present in said layer comprising silver halide and light insensitive silver source in an amount comprising from 0.5 to 20% by weight of said polyvinyl acetal.

5. The element of claim 1 wherein the number average size of the silver halide grains is between 0.01 and 0.08 $\mu$m.

6. The element of claim 1 in which said support comprises a transparent organic polyethylene taephthalate layer.

7. The element of claim 1 wherein said metal soap particles are present in said emulsion layer.

8. The element of claim 1 wherein said polyvinyl acetal comprises polyvinyl butyral.

9. The element of claim 1 wherein said particulate comprises a metal soap derived from Group I or Group II metals.

10. The element of claim 9 wherein said metal soap is a soap of a carboxylic acid.

11. The element of claim 10 wherein said aliphatic carboxylic acid comprises an acid having from 10–30 carbon atoms.

12. The element of claim 1 wherein said adhesion promoting resin is dissolved in said photothermographic layer in an amount of from 0.5 to 40% by weight of said polyvinyl acetal.

13. The element of claim 12 wherein said adhesion promoting resin is selected from the group consisting of polyketone and polyvinyl pyrrolidone/vinyl acetate.

14. A spectrally sensitized photothermographic silver halide element comprising a polyester support having directly coated thereon a photothermographic emulsion layer comprising a polyvinyl acetal binder, a light insensitive silver source, a reducing agent for silver ion, and radiation sensitive silver halide grains, wherein said photothermographic emulsion layer further comprises an adhesion promoting amount of a polymer having better adhesion to said polyester support than said polyvinyl acetal said polymer being selected from the group consisting of cellulose acetate butyrate, polyesters, styrene-butadiene, vinyl toluene-butadiene, polyketone, and polyvinyl pyrrolidone/vinyl acetate.

15. The element of claim 14 wherein high density areas of image developed in said element have higher adhesion to said polyester support than high density areas of image developed in a second element differing from said element only by the absence of said adhesion promoting materials.

16. A spectrally sensitized photothermographic silver halide element comprising a polyester support having on at least one surface thereof a photothermographic emulsion layer comprising a polyvinyl acetal binder, a light insensitive silver source, a reducing agent for silver ion, and radiation sensitive silver halide grains, wherein said photothermographic emulsion layer further comprises an adhesion promoting amount of particulate metal soap other than a silver soap, said particulate metal soap other than a silver soap and derived from Group I or Group II metals that does not oxidize as part of an imaging photothermographic process in said element, wherein high density areas of image developed in said element have higher adhesion to said support than high density areas in a second element which differs from said element by only the absence of said adhesion promoting materials.

17. The element of claim 16 wherein said adhesion promoting metal soap comprises magnesium or zinc soaps.

18. The element of claim 17 wherein said zinc or magnesium soaps comprise zinc stearate or magnesium stearate.

19. A spectrally sensitized photothermographic silver halide element comprising a polyester support having directly coated thereon a photothermographic emulsion layer comprising a polyvinyl acetal binder, a light insensitive silver source, a reducing agent for silver ion, and radiation sensitive silver halide grains, wherein said photothermographic emulsion layer further comprises an adhesion promoting amount of a polymer having better adhesion to said polyester support than said polyvinyl acetal, wherein said polymer is selected from the group consisting of cellulose acetate butyrate, styrene-butadiene, vinyl toluene-butadiene, polyketone, and polyvinyl pyrrolidone/vinyl acetate.

20. The element of claim 19 wherein the amount of the polymer is from 0.5 to 20% by weight of the polyvinyl acetal in the emulsion layer.

* * * * *